US007014539B1

(12) United States Patent
Charatan

(10) Patent No.: US 7,014,539 B1
(45) Date of Patent: Mar. 21, 2006

(54) METHOD AND APPARATUS FOR MINIMIZING AGGLOMERATE PARTICLE SIZE IN A POLISHING FLUID

(75) Inventor: Robert Charatan, Portland, OR (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/991,669

(22) Filed: Nov. 18, 2004

(51) Int. Cl.
*B24B 1/00* (2006.01)

(52) U.S. Cl. ..... 451/56; 451/60; 451/446

(58) Field of Classification Search ..... 451/56, 451/60, 41, 443, 444, 446, 72
See application file for complete search history.

(56) References Cited

U.S. PATENT DOCUMENTS 6,024,829 A * 2/2000 Easter et al. ..... 156/345.12
6,077,785 A * 6/2000 Andreas ..... 438/692
6,585,570 B1 * 7/2003 Kim et al. ..... 451/60
6,769,967 B1 * 8/2004 Southwick ..... 451/56
6,800,020 B1 * 10/2004 Boyd et al. ..... 451/56

* cited by examiner

*Primary Examiner*—Dung Van Nguyen
(74) *Attorney, Agent, or Firm*—Brinks Hofer Gilson & Lione

(57) ABSTRACT

An apparatus and method for minimizing the size of agglomerated particles in a polishing fluid is provided. The method includes positioning a polishing pad between a sacrificial member and a support member such that the sacrificial member is in communication with the polishing pad, thereby causing the agglomerated particles to separate. The apparatus includes a polishing pad and a polishing fluid condition. The polishing fluid conditioner includes a sacrificial member and a support member, wherein the sacrificial member is in communication with the polishing pad so as to cause the agglomerated particles to separate.

19 Claims, 2 Drawing Sheets

METHOD AND APPARATUS FOR MINIMIZING AGGLOMERATE PARTICLE SIZE IN A POLISHING FLUID

FIELD OF THE INVENTION

This invention relates to chemical mechanical planarization (CMP) systems, and more particularly, to an apparatus for minimizing agglomerate particle size in a polishing fluid.

BACKGROUND

Semiconductor wafers are typically fabricated with multiple copies of a desired integrated circuit design that will later be separated and made into individual chips. A common technique for forming the circuitry on a semiconductor wafer is photolithography. Part of the photolithography process requires that a special camera focus on the wafer to project an image of the circuit on the wafer. The ability of the camera to focus on the surface of the wafer is often adversely affected by inconsistencies, unevenness, or scratches on the wafer surface. This sensitivity is accentuated with the current drive for smaller, more highly integrated circuit designs which cannot tolerate certain nonuniformities within a particular die or between a plurality of dies on a wafer. Because semiconductor circuits on wafers are commonly constructed in layers, where a portion of a circuit is created on a first layer and conductive vias connect it to a portion of the circuit on the next layer, each layer can add or create nonuniformity on the wafer that must be smoothed out before generating the next layer.

Chemical mechanical planarization (CMP) techniques are used to planarize the raw wafer and each layer of material added thereafter. Available CMP systems, commonly called wafer polishers, often use a rotating wafer holder that brings the wafer into contact with a polishing pad moving in the plane of the wafer surface to be planarized. The polishing pad used in the CMP process is typically a disk or a belt. In some systems, a polishing fluid, such as a chemical polishing agent or a slurry containing microabrasives, is employed. The wafer holder then presses the wafer against the rotating polishing pad and is rotated to polish and planarize the wafer in order to create a smooth surface and remove any nonuniformities. The surface of the wafer is often completely covered by, and in contact with, the polishing pad to simultaneously polish the entire wafer surface.

During the planarization process of a wafer, scratches on the surface of the wafer being polished can result. These scratches may be caused by agglomeration of particles suspended in the polishing fluid. These agglomerates can comprise several small particles that are tightly bound together to form larger particles. As such, these large particles can be reduced in size through mechanisms capable of separating the small particles in a manner in which they can be dispersed throughout the polishing fluid.

Agglomerates of particles can form as a result of microabrasives that are suspended in a polishing fluid that do not become distributed throughout the polishing fluid. These microabrasives can be formed when the polishing fluid is manufactured such that the particles are not thoroughly dispersed throughout the polishing fluid. Alternatively, the agglomerates may form during the application of the polishing fluid from a polishing fluid dispensing mechanism of a CMP apparatus. The formation of the agglomerates may occur through a variety of different methods or result from particular chemicals or processes leading up to, or including, the planarization of a semiconductor wafer. A disadvantage of the presence of the agglomerates in the polishing fluid during planarization is that these large particles can cause scratches on the surface of the wafer. The scratches produced by the agglomerates during planarization of a wafer can damage, or even destroy, features on a wafer, thereby rendering sections or all of a wafer useless.

BRIEF SUMMARY

The present invention provides for a method and apparatus for minimizing agglomerate particle size in a polishing fluid. The embodiments described herein provide for dispersal of particles that form the agglomerates in a polishing fluid, thereby minimizing the size of the agglomerated particles.

According to a first aspect of the present invention, a wafer polisher is provided. The wafer polisher includes a polishing pad, a wafer carrier, a polishing fluid dispensing mechanism, a pad conditioner, and a polishing fluid conditioner. The polishing fluid conditioner is positioned adjacent to the polishing pad, and is configured to reduce the size of an agglomerate of particles in the polishing fluid.

According to another aspect of the present invention, a method for minimizing the size of agglomerated particles in a polishing fluid is provided. The method includes providing a support member and a sacrificial member having a contact surface. The method also includes reducing the size of agglomerated particles in the polishing fluid such that contact between the contact surface and the agglomerated particles causes the agglomerated particles to separate.

Advantages of the present invention will become more apparent to those skilled in the art from the following description of the preferred embodiments of the invention which have been shown and described by way of illustration. As will be realized, the invention is capable of other and different embodiments, and its details are capable of modification in various respects. Accordingly, the drawings and description are to be regarded as illustrative in nature and not as restrictive.

DETAILED DESCRIPTION OF THE DRAWINGS AND THE PRESENTLY PREFERRED EMBODIMENTS

A method and assembly for minimizing the size of agglomerate particles on a polishing pad during chemical-mechanical planarization (CMP), and in particular during linear planarization, is described. In the following description, numerous specific details are set forth, such as specific structures, materials, polishing techniques, etc., in order to provide a thorough understanding of the present invention. However, it will be appreciated by one skilled in the art that the present invention is not limited to the specific examples disclosed. In other instances, well known techniques and structures have not been described in detail in order not to obscure the present invention. Although one embodiment of the present invention is described in reference to a linear polisher, other types of polishers, such as rotary polishers, are also contemplated. Furthermore, although the present invention is described in reference to performing a CMP process on a semiconductor wafer, the invention is adaptable for polishing other materials as well.

Figure 1:
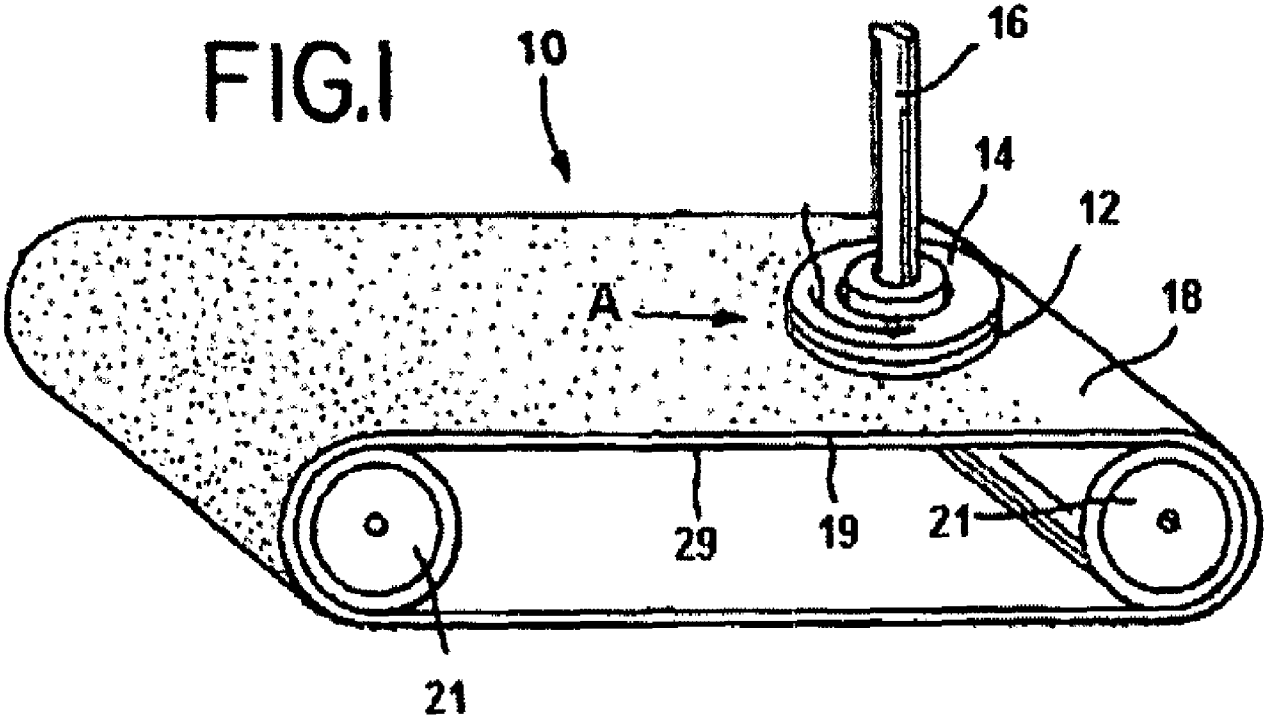
FIG.1 PRIOR ART
FIG. 1 is a top perspective view of one embodiment of a wafer polisher.

Referring to FIG. 1, a wafer polisher 10, or CMP system, for use in chemical-mechanical planarization of a semiconductor wafer 12 is shown. The wafer polisher 10 is utilized in polishing a semiconductor wafer 12, such as a silicon wafer, to polish away materials and residue on the surface of the semiconductor wafer 12. The wafer polisher 10 may be any device that provides planarization to a substrate surface, and therefore can include, but is not limited to, systems such as a linear polisher, a radial polisher, and an orbital polisher. In an exemplary embodiment, a wafer polisher 10 includes a rotating wafer carrier 14 attached to a shaft 16 that brings a semiconductor wafer 12 into contact with a polishing pad 18 moving in a linear direction A in the plane of the semiconductor wafer surface to be planarized. The polishing pad 18 is extended about a pair of spaced-apart rollers 21. The wafer carrier 14 then presses the semiconductor wafer 12 against the surface of the moving, linear polishing pad 18 wetted with a polishing fluid 20, and the semiconductor wafer 12 is rotated to be polished and planarized.

Figure 2:
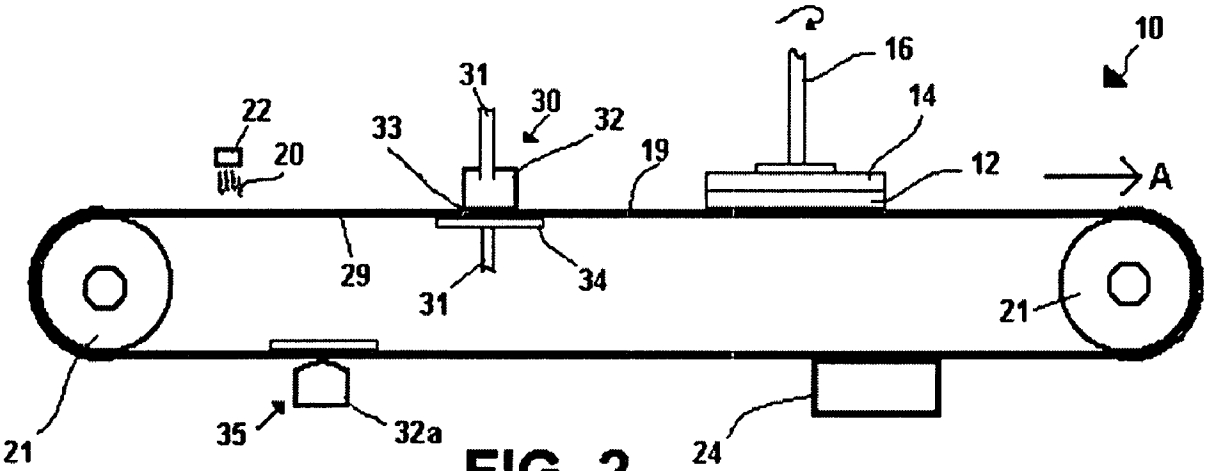
FIG. 2 is a side view of a second embodiment of a wafer polisher.

A polishing fluid, such as a slurry 20, is dispensed by a polishing fluid dispensing mechanism 22 onto the polishing surface 19 of the polishing pad 18 to aid in removing material from the semiconductor wafer 12 during the CMP process, as illustrated in FIG. 2. The polishing surface 19 of the polishing pad 18, as described hereinafter, is the entire continuous surface of the polishing pad 18 on which the wafer 12 can be polished. For example, as illustrated in FIG. 1, the polishing surface 19 is the entire outwardly directed surface of the polishing pad 18. It should be understood by one skilled in the art that the polishing fluid can be a homogenous liquid, a colloid containing microabrasives, or any other type of fluid sufficient to aid in the planarization of the surface of a semiconductor wafer 12.

A polishing fluid commonly used in the CMP process is a colloidal slurry that contains microabrasive particles that are suspended in a fluid. The slurry 20 is applied to the polishing surface 19 of the polishing pad 18 by a polishing fluid dispensing mechanism 22, as shown in FIG. 2. The slurry 20 is configured to provide a thin barrier between the wafer 12 and the polishing surface 19 in which the slurry 20 can include chemical agents to aid in the removal of a small layer of the wafer 12 resulting in a wafer having a substantially planar surface. The microabrasives in the slurry 20 act in cooperation with the fluid to polish the surface of the wafer 12. Microabrasive particles are generally between about one-tenth and fifteen-hundredths of a micrometer (~0.1–0.15$\mu$) in diameter. The microabrasives are typically particles of a dielectric, such as silica or alumina. However, it should be understood by one skilled in the art that the polishing fluid may be a liquid without these particles or variants of these particles.

Figure 3:
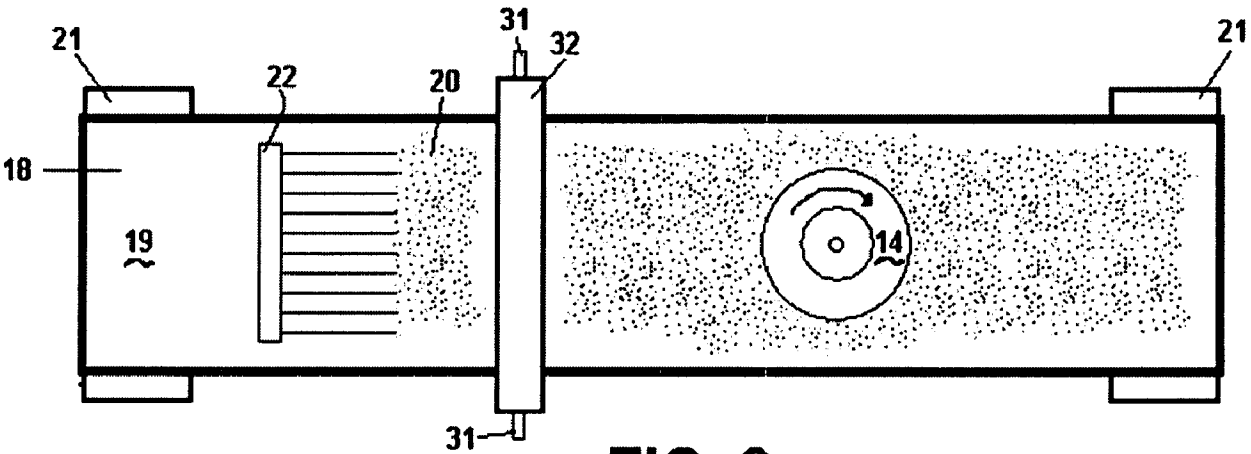
FIG. 3 is a top view of the wafer polisher of FIG. 2.

As illustrated in FIGS. 2–3, the planarization of a wafer 12 performed by the wafer polisher 10 preferably includes application of a slurry 20 onto the polishing surface 19 of the polishing pad 18, wherein the polishing pad 18 is translating between a pair of spaced-apart rollers 21 and the wafer carrier 14 rotates the wafer 12 such that the surface of the wafer abuts the polishing surface 19. After the planarization of the wafer is completed, the slurry 20 that remained on the polishing pad 18 is combined with the particles of substrate that were removed from the wafer 12 during the planarization process. As the polishing pad 18 rotates around the roller 21 subsequent to the wafer being planarized, a portion of the microabrasives from the slurry 20 as well as particles of substrate removed from the wafer 12 become dislodged from the polishing surface 19 and fall off the polishing pad, as shown in FIG. 2. Because a portion of the microabrasives and particles of substrate remain on the polishing surface 19 as the polishing pad 18 moves past the wafer carrier 14, a pad conditioner 24 is preferably disposed adjacent to, and contacts, the polishing surface 19 so as to condition the polishing pad 18 prior to the application of additional slurry 20 and the planarization process being repeated.

The pad conditioner 24 is configured to contact the polishing surface 19 of the polishing pad 18. Without a pad conditioner 24, the polishing pad 18 tends to become smooth, thereby reducing the effectiveness and longevity of the polishing pad 18. The pad conditioner 24 extends the life of the polishing pad 18 by removing the build-up of particulates from the polishing surface 19 as well as maintaining and regenerating a surface sufficient to planarize a wafer 12. Because the pad conditioner 24 is configured to remove slurry 20 and embedded particles from the polishing pad 18, a new application of slurry 20 is applied to replenish both the fluid as well as the microabrasives necessary to remove particles of substrate from the wafer 12 during the planarization process.

During the planarization process, large particles on the polishing pad 18 tend to cause scratching on the surface of the wafer 12. The scratches can be caused by an agglomerate of abrasive material that may include microabrasives from the slurry 20 in addition to particles of substrate removed from the wafer 12. The scratches in the surface of the wafer 12 cause an uneven surface, and can cause considerable difficulty in applying additional functional layers of substrate and conductive material to the wafer 12. As a result, a polishing fluid conditioner 30 is preferably incorporated into the wafer polisher 10 in order to reduce, or minimize the size of agglomerated particles. As an additional advantage, the polishing fluid conditioner 30 can also be configured to reduce the size of asperities on the polishing surface 19 of the polishing pad 18.

In the preferred embodiment, the polishing fluid conditioner 30 includes a sacrificial member 32 and a support member 34. The sacrificial member 32 is preferably an elongated member that is located adjacent to the polishing surface 19 of the polishing pad 18, and the sacrificial member 32 includes a contact surface 33 that is adapted to allow for direct communication, in an abutting manner, with the polishing surface 19 as the polishing fluid is being conditioned. The support member 34 is a similarly elongated member that is oriented in a substantially parallel manner with respect to the sacrificial member 32. The support member 34 preferably has a greater length and width relative to the polishing surface 19 than the sacrificial member 32 such that the support member 34 ensures communication between the contact surface 33 and the polishing surface 19 as the polishing fluid is being conditioned. The support member 34 is located adjacent to the rear surface 29 of the polishing pad 18, opposite the sacrificial member 32, such that the polishing pad 18 is located between the sacrificial member 32 and the support member 34. The sacrificial member 32 and the support member 34 are preferably oriented in a substantially transverse direction relative to the translational direction A of the polishing pad 18. The sacrificial member 32 and support member 34 are preferably of sufficient length relative to the transverse direction of the polishing pad 18 such that the area of polishing fluid on the polishing pad being conditioned is at least as wide as the diameter of the wafer being polished.

The sacrificial member 32 and the support member 34 are preferably maintained at a constant position relative to the polishing pad 18 by the structural framework 31 of the wafer polisher 10, a portion of which is illustrated in FIG. 2. The support member 34 is in continual contact with the rear surface 29 of the polishing pad 18, and the sacrificial member is preferably in continuous contact with the polishing surface 19 of the polishing pad 18. In an alternative embodiment, the sacrificial member 32 contacts the polishing surface 19 of the polishing pad 18 with a nominal downward force directed toward the polishing surface 19. This nominal downforce may be applied in either a continuous or a discontinuous manner to the polishing pad 18. The support member 34 provides support to the polishing pad 18 so as to prevent the polishing pad 18 from deflecting due to the pressure, or downforce, resulting from the contact between the sacrificial member 32 and the polishing surface 19. The support member 34 ensures abutting contact between the sacrificial member 32 and the polishing pad 18. In a further alternative embodiment, as the sacrificial member 32 contacts the polishing surface 19 the downforce is applied to the sacrificial member 32 and removed therefrom at a pre-determined later time, wherein the sacrificial member 32 maintains contact with the polishing surface 19 both before and after the downforce is applied to the sacrificial member.

The contact between the sacrificial member 32 and the polishing pad 18 is configured to reduce the size of agglomerates of particles by causing the agglomerates to break apart and the individual particles to be distributed throughout the polishing fluid. In operation, as the polishing pad 18 passes between the sacrificial member 32 and the support member 34, the polishing fluid conditioner 30 is preferably configured such that the agglomerated particles contact the contact surface 33 of the sacrificial member 32. As the agglomerated particles impact the contact surface 33 of the sacrificial member 32, the sacrificial member 32 creates a compressive pressure upon the agglomerated particles sufficient to overcome the bonds between the particles of the agglomerate, thus resulting in the particles of the agglomerate separating and being dispersed throughout the fluid prior to reaching the surface of the wafer 12 being planarized. Thus, the sacrificial member 32 is configured to supplant the wafer 12 as the component that first contacts the agglomerates, thus reducing their size, or eliminating the agglomerated particles such that the polishing fluid is thereby conditioned. The sacrificial member 32 is adapted to reduce, or eliminate the agglomerated particles within the polishing fluid yet allow the dissipated particles to remain within the polishing fluid that remains on the polishing surface such that the particles may be utilized during the planarization process or removed by the pad conditioner 24 subsequent to the polishing fluid being conditioned by the polishing fluid conditioner 30.

In addition, the contact between the sacrificial member 32 and the polishing surface 19 of the polishing pad 18 can also reduce, or eliminate, asperities that are present on the polishing surface 19 as a result of the pad conditioning process by the pad conditioner 24. During the pad conditioning process, the pad conditioner 24 regenerates the pad surface by a roughening mechanism. The pad conditioner 24 can include abrasive material to also assist in removing loose particles residing on the polishing surface 19 after the polishing process, dislodging particles embedded into the polishing surface 19, and can also reorient particles or sections of thin films of grit on the polishing pad. The reorientation of this grit causes asperities resulting from the grit extending above the polishing surface of the polishing pad to the extent that the asperities can likewise cause detrimental scratches to the surface of the wafer 12 being polished. However, when the sacrificial member 32 is in contact with the polishing surface 19 of the polishing pad, these asperities contact the contact surface 33 in the same manner as the agglomerate particles. The contact between the asperities and the contact surface 33 can either cause the grit to become disengaged from the polishing pad 18, or reposition the grit by depressing it back toward or into the polishing pad which is typically made of a polyurethane material or the like, thereby reducing the height at which the grit extends above the polishing pad 18 and eliminating or reducing the asperity. It should be understood by one skilled in the art that the polishing fluid conditioner is configured to lessen the likelihood of scratches on the surface of the wafer being polished by reducing or eliminating agglomerate particles in the polishing fluid, but the polishing fluid conditioner can also be configured to reduce the height at which particles of grit extend from the polishing pad after the pad conditioning process.

In the preferred embodiment, the sacrificial member 32 is made of a material that is chemically inert with respect to the slurry 20 and abrasive agglomerates such that there is no chemical reaction between the slurry 20 or abrasive agglomerates and the sacrificial member 32 when the contact surface 33 is in communication with the polishing surface 19. In another embodiment, the sacrificial member 32 is formed of a material having similar strength and chemically reactive properties to the conductive material used in the manufacture of the wafer 12 being polished. For example, if the conductive material used in the manufacture of the wafer 12 is copper, the sacrificial member 32 is likewise formed of copper in order to reduce or eliminate contamination of the slurry 20. It should also be understood by one skilled in the art that the sacrificial member can be made from a material that erodes in a uniform or controlled manner. Potential contamination can occur when particles of a substance other than the materials used in the wafer 12 become disposed on the polishing pad 18 as the particles are removed from the sacrificial member 32 from being scratched by an agglomerate of abrasive particles. The foreign contaminate may adversely react with the chemical fluid in which the microabrasives are suspended in the slurry, or the foreign particles may also be of a substance that is harder than those used in the manufacture of the wafer 12, thereby increasing the likelihood of scratches resulting from the harder particles.

In an alternative embodiment, the contact surface 33 of the sacrificial member 32 is coated with a material that is much harder than the microabrasives of the slurry 20 and the substrate of the wafer. For example, the sacrificial member 32 can be formed with a diamond coating on the contact surface 33, because the diamond coating on the sacrificial member 32 will not chemically react with the polishing fluid and the coating also resists scratches from both the microabrasives in the slurry 20 as well as the substrate of the wafer 12. The diamond-coated contact surface 33 is configured to be in communication with the polishing surface 19 in an abutting manner, thereby creating a compressive force directed to the agglomerate that causes the particles of the agglomerate to separate and disperse throughout the fluid. It should be understood by one skilled in the art that the sacrificial member 32 can be coated with any material sufficient to withstand the chemical composition of the polishing fluid as well as provide a surface capable of causing agglomerates to break apart as they pass the polishing fluid conditioner 30.

The shape of the contact surface 33 of the sacrificial member 32 can vary. In one embodiment, the sacrificial member 32 is formed as a rectangular block, as illustrated in FIGS. 2–3. The rectangular sacrificial member 32 provides a generally uniform, planar contact surface 33 that is in direct communication with the polishing surface 19 of the polishing pad 18. In an alternative embodiment, the sacrificial member 36 has a curvilinear contact surface that is configured to be in communication the polishing pad 18, as illustrated in FIG. 2. The rounded contact surface of the sacrificial member 36 distributes the contact pressure along a linear edge that is in communication with the polishing surface 19, thereby providing a more concentrated pressure between the sacrificial member 32 and the polishing surface 19. In a further alternative embodiment (not shown), the sacrificial member has a circular cross-section and is adapted to rotate about an axis that is generally transverse to the translational direction of the polishing pad. The circular outer surface of the sacrificial member is thus configured as the contact surface being in communication with the polishing surface. In still another alternative embodiment, the shape of the contact surface of the sacrificial member is adapted such that pressure is distributed to the polishing surface 19 of the polishing pad 18 in a non-uniform manner.

The polishing fluid conditioner 30 is preferably disposed at a location at which it is more likely that agglomerates are present. In a first embodiment, a polishing fluid conditioner 30 is disposed along the polishing pad 18 between the polishing fluid dispensing mechanism 22 and the rotating wafer carrier 14. In a second embodiment, a polishing fluid conditioner 35 is disposed along the polishing pad 18 between the pad conditioner 24 and the slurry dispensing mechanism 22. In a third embodiment, a polishing fluid conditioner 30 is disposed between the polishing fluid dispensing mechanism 22 and the rotating wafer carrier 14 and a second polishing fluid conditioner 35 is disposed between the pad conditioner 24 and the slurry dispensing mechanism 22. It should be understood by one skilled in the art that any number of polishing fluid conditioners can be incorporated into the wafer polisher 10 and these polishing fluid conditioners 30 can be located at any position adjacent to the polishing pad 18 and at any point along the path of the polishing surface 19.

In the first embodiment, the polishing fluid conditioner 30 is disposed between the polishing fluid dispensing mechanism 22 and the wafer carrier 14, as illustrated in FIGS. 2–3. One advantage of positioning the polishing fluid conditioner 30 at a location along the polishing pad 18 subsequent to the application of slurry 20 and prior to the planarization process is that any particles that were not removed by the pad conditioner 24 prior to the application of fresh slurry 20 may become agglomerated, thereby requiring the sacrificial member 32 to reduce the size of the agglomerate and dispersing the particles throughout the polishing fluid before the planarization process. Another advantage of positioning the polishing fluid conditioner 30 at a location subsequent to the polishing fluid dispensing mechanism 22 is that the sacrificial member 32 enhances the possibility that agglomerates of microabrasives in the slurry 20 being dispensed from the polishing fluid dispensing mechanism 22 will be dispersed prior to the planarization process.

In the second embodiment, the polishing fluid conditioner 35 is disposed between the pad conditioner 24 and the slurry dispensing mechanism 22, as illustrated in FIG. 2. The polishing fluid conditioner 35 can be disposed along the top of the wafer polisher 10, in a substantially coplanar orientation with the wafer carrier 14, or on the underside of the wafer polisher 10 as illustrated in FIG. 2. When the polishing fluid conditioner 35 is disposed on the underside of the wafer polisher 10, the sacrificial member 36 maintains direct communication between the sacrificial member 36 and the polishing pad 18 in an abutting manner. An advantage of positioning the polishing fluid conditioner 35 at a location along the polishing pad 18 that is subsequent to the pad conditioner 24 and prior to the slurry dispensing mechanism 22 is that agglomerates formed of microabrasives in the slurry 20 or a mixture of microabrasives in the slurry and particles of substrate from the planarized wafer 12 is that the agglomerated particles can be dissipated prior to reaching the wafer 12 being polished but prior to additional slurry being applied to the polishing surface 19. Thus, deleterious effects due to vibrations caused by the interaction between the polishing pad 18 and the pad conditioner 24 can be reduced. Additionally, by positioning the polishing fluid conditioner 35 adjacent the polishing pad 18 at a location subsequent to the pad conditioning process, the polishing fluid conditioner 35 can reduce or eliminate the asperities generated during the pad conditioning process by the pad conditioner 24.

In the third embodiment, a first polishing fluid conditioner 30 is located along the polishing pad 18 between the polishing fluid dispensing mechanism 22 and the wafer carrier 14 and a second polishing fluid conditioner 35 is located along the polishing pad 18 between the pad conditioner 24 and the slurry dispensing mechanism 22, as illustrated in FIG. 2. In this embodiment, the polishing fluid conditioners 30, 35 are disposed at locations in which the agglomerated particles may be present. Thus, by positioning the polishing pad conditioners 30, 35 in these positions to minimize, or eliminate the agglomerates, the likelihood of the planarized wafer surface becoming scratched is reduced.

In one embodiment of a wafer polisher 10, a polishing fluid conditioner 30 is disposed adjacent to the polishing pad 18 such that the contact surface 33 of the sacrificial member 32 is in constant communication with polishing surface 19 of the polishing pad. Accordingly, the contact surface 33 provides a constant conditioning effect to minimize, or eliminate the agglomerate of particles. In an alternative embodiment, a polishing fluid conditioner is adapted to be in continuous communication with the polishing surface 19 for a fixed amount of time. For example, the contact surface 33 of the sacrificial member is adapted to be in direct communication with the polishing surface 19 for the first two (2) seconds of the planarization process, at which time the sacrificial member 32 is actuated in a direction away from the polishing pad 18 such that the contact surface 33 becomes disengaged from the polishing surface 19. In a further alternative embodiment, the polishing fluid conditioner 30 can be configured to provide cyclical communication between the contact surface 33 and the polishing surface 19 in a periodic, non-periodic, or random manner such that the sacrificial member 32 is actuated toward and away from the polishing pad 18 so as to apply and remove the abutting pressure from the sacrificial member 32 to the polishing surface 32. However, it should be understood by one skilled in the art that each polishing fluid conditioner 30 integrated with a wafer polisher 10 can be configured such that the contact surface 33 of the sacrificial member 32 is in communication with the polishing surface in a continuous manner, or any other manner sufficient to minimize, or remove an agglomerate of particles from said polishing pad 18.

It should be understood by one skilled in the art that the polishing fluid conditioner 30 can be positioned along the polishing pad 18 at any location in order to effectuate the reduction in both the quantity and size of agglomerates of particles on the polishing surface 19 of the polishing pad 18. It should also be understood by one skilled in the art that any number of polishing fluid conditioners 30 can be positioned along the polishing pad 18 in order to maximize the effectiveness of the polishing fluid conditioner 30 in reducing the quantity and size of agglomerates on the polishing surface 19.

While preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

What is claimed is:

1. A polishing fluid conditioner for use in a wafer polisher, wherein said wafer polisher includes a polishing pad having a polishing surface and a rear surface, a pad conditioner and a wafer carrier and each positioned adjacent to said polishing pad, a polishing fluid dispensing mechanism adapted to dispense a polishing fluid onto said polishing surface, said polishing fluid conditioner comprising:

a sacrificial member located adjacent to said polishing surface, said sacrificial member adapted to contact an agglomerate of particles within said polishing fluid wherein said contact between said sacrificial member and said agglomerate of particles reduces the size of said agglomerate of particles; and a support member disposed adjacent to said rear surface and opposite said sacrificial member.

2. The polishing fluid conditioner of claim 1, wherein said sacrificial member includes a contact surface.

3. The polishing fluid conditioner of claim 2, wherein said contact surface is configured to be in communication with said polishing surface.

4. The polishing fluid conditioner of claim 3, wherein a structural framework of said wafer polisher maintains said contact surface in continuous communication with said polishing surface.

5. The polishing fluid conditioner of claim 1, wherein said sacrificial member is adapted to reduce the size of said agglomerate of particles having a diameter greater than about two-tenths micrometers ($0.2\mu$).

6. The polishing fluid conditioner of claim 1, wherein said sacrificial member is positioned adjacent to said polishing surface at a location along said polishing surface subsequent to said wafer carrier and prior to said polishing pad.

7. The polishing fluid conditioner of claim 1, wherein said sacrificial member is positioned adjacent to said polishing surface at a location along said polishing surface subsequent to said pad conditioner and prior to said slurry dispensing mechanism.

8. The polishing fluid conditioner of claim 1, wherein said polishing fluid includes microabrasives.

9. The polishing fluid conditioner of claim 8, wherein said sacrificial member is made of the same material as said microabrasives of said polishing fluid.

10. The polishing fluid conditioner of claim 8, wherein said sacrificial member is made of a material that is harder than said microabrasives of said polishing fluid.

11. The polishing fluid conditioner of claim 1, wherein said sacrificial member is oriented in a substantially transverse direction relative to said polishing pad.

12. The polishing fluid conditioner of claim 11, wherein said support member is oriented in a substantially parallel relationship with said sacrificial member.

13. A semiconductor wafer polisher comprising:

a polishing pad having a polishing surface and a rear surface;

a wafer carrier adapted to secure a semiconductor wafer;

a polishing fluid dispensing mechanism configured to dispense a polishing fluid onto said polishing surface;

a pad conditioner adapted to condition the polishing surface of said polishing pad;

a polishing fluid conditioner located adjacent to said polishing pad, wherein said polishing fluid conditioner includes a sacrificial member and a support member, and said polishing fluid conditioner configured to reduce the size of an agglomerate of particles in said polishing fluid.

14. The wafer polisher of claim 13, wherein said sacrificial member is positioned adjacent to said polishing surface.

15. The wafer polisher of claim 14 wherein said support member is positioned adjacent to said rear surface and opposite said sacrificial member.

16. The wafer polisher of claim 13, wherein said sacrificial member includes a contact surface in communication with said polishing surface.

17. The wafer polisher of claim 16 wherein said contact surface is configured to contact said agglomerate of particles in said polishing fluid to reduce the size of said agglomerate of particles.

18. The wafer polisher of claim 17 wherein said contact surface is adapted to reduce the size of said agglomerate of particles having a diameter greater than about two-tenths micrometers ($0.2\mu$).

19. A method for minimizing the size of agglomerated particles in a polishing fluid applied to a polishing pad comprising:

providing a sacrificial member having a contact surface;

providing a support member; and reducing the size of said agglomerated particles in said polishing fluid in which contact between said contact surface and said agglomerated particles causes said agglomerated particles to separate.

* * * * *